US007128543B2

(12) United States Patent
Scholz et al.

(10) Patent No.: US 7,128,543 B2
(45) Date of Patent: Oct. 31, 2006

(54) COMPRESSOR MACHINE WITH TWO COUNTER-ROTATING ROTORS

(75) Inventors: Fritz-Martin Scholz, Hasel (DE); Wolf-Rudiger Wagener, Schopfheim (DE); Daniel Greiner, Zell i.W. (DE)

(73) Assignee: Rietschle Thomas Schopfheim, GmbH, Schopfheim (DE)

( * ) Notice: Subject to any disclaimer, the term of this patent is extended or adjusted under 35 U.S.C. 154(b) by 0 days.

(21) Appl. No.: 10/532,532

(22) PCT Filed: Oct. 24, 2003

(86) PCT No.: PCT/EP03/11853

§ 371 (c)(1),
(2), (4) Date: Apr. 25, 2005

(87) PCT Pub. No.: WO2004/038227

PCT Pub. Date: May 6, 2004

(65) Prior Publication Data

US 2006/0051231 A1 Mar. 9, 2006

(30) Foreign Application Priority Data

Oct. 25, 2002 (DE) ..... 202 16 504 U

(51) Int. Cl.
*F01C 1/08* (2006.01)
*F03C 2/00* (2006.01)

(52) U.S. Cl. ..... 418/191; 418/206.1; 418/206.2

(58) Field of Classification Search ..... 418/201.1, 418/206.1, 206.2, 206.6, 206.7, 191, 250, 418/205

See application file for complete search history.

(56) References Cited

U.S. PATENT DOCUMENTS 1,386,792 A 8/1921 Needham
2,188,752 A * 1/1940 Houghton ..... 418/191
2,635,552 A 4/1953 Dale et al.
2,642,808 A 6/1953 Thomas
4,057,375 A * 11/1977 Nachtrieb ..... 418/206.1
4,457,680 A * 7/1984 Paget ..... 418/191
4,772,187 A * 9/1988 Thompson ..... 418/191
6,729,863 B1 * 5/2004 Scholz ..... 418/191
2003/0133820 A1 7/2003 Scholz

FOREIGN PATENT DOCUMENTS

AU 140405 A1 * 12/1949 ..... 418/191
EP 0 048 095 3/1982
EP 48095 A * 3/1982 ..... 418/206.5
EP 0 444 941 A1 9/1991

(Continued)

*Primary Examiner*—Theresa Trieu
(74) *Attorney, Agent, or Firm*—Barnes & Thornburg LLP; James B. Conte

(57) ABSTRACT

The compressor machine has two rotors rotating in opposite directions, which are fitted to two parallel, spaced apart shafts mounted in a housing. One of the shafts is driven directly and the other by intermeshing toothed gears mounted on the shafts. The housing has two radial walls which are configured in one piece with each other and with a peripheral wall and in which the shafts are mounted. The toothed gears are arranged between these radial walls. A side wall of the housing has an opening sealed by a removable cover. With the cover removed, the toothed gears can be fitted to the shafts through these openings. The bearing bores for the shafts can be produced and machined in the one-piece housing in a single set-up, so that, with a minimum number of parts, any causes of alignment errors are avoided.

7 Claims, 4 Drawing Sheets

FOREIGN PATENT DOCUMENTS

| | | |
|---|---|---|
| FR | 1 480 749 | 5/1967 |
| WO | WO 0057062 | 9/2000 |

* cited by examiner

COMPRESSOR MACHINE WITH TWO COUNTER-ROTATING ROTORS

FIELD OF INVENTION

The present invention relates to a compressor machine comprising two rotors rotating in opposite directions, which are fitted to two parallel, spaced apart shafts mounted in a housing, one of the shafts being driven directly and the other by intermeshing toothed gears mounted on the shafts.

BACKGROUND OF THE INVENTION

Compressor machines with two rotors rotating in opposite directions can operate as compressors or vacuum pumps. EP 1 163 450 A1 discloses a machine of this type, having claw-type rotor blades, which is adapted to generate both suction air and blown air and is particularly suitable for use in the field of paper processing. The internal compression of machines of this type allows to attain markedly higher pressure ratios than for instance by means of a Roots pump. The cantilevered arrangement of the rotors in a pot-shaped housing results in a simple structure. However, the gear that couples the two shafts, on the one hand, and the shaft mounting, on the other hand, are disposed in separate housing parts which need to be exactly aligned with each other and pinned together. Similarly, the pot-shaped housing accommodating the rotors needs to be precisely pinned together with the gear casing. This results in the requirement of having to machine pin holes from two different sides of a housing part as precisely as possible. Any imprecision will lead to slanting shafts and thereby to increased bearing loads, toothed gear noises, and other malfunctions.

SUMMARY OF THE INVENTION

The invention provides a compressor machine which ensures a precise orientation of the shafts in spite of a simplified manufacturing and a reduced number of parts.

The compressor machine according to the invention comprises a housing, two parallel, spaced apart shafts mounted in the housing, intermeshing toothed gears mounted on the shafts, one of the shafts being driven directly and the other by said intermeshing toothed gears and two rotors rotating in opposite directions, which are fitted to the two parallel, spaced apart shafts. The housing further includes axial passages, two radial walls which are configured in one piece with each other and with a peripheral wall and in which the shafts are mounted and between which the toothed gears are arranged. One of the radial walls is a radial outer wall and the other is an intermediate wall which on one side thereof defines together with the radial outer wall a gear chamber receiving the toothed gears and on the other side thereof defines a working chamber receiving the rotors. On an end-face facing away from the intermediate wall, the working chamber is sealed by a radial housing cover. The intermediate wall has axial through openings for accommodating shaft bearings having a width larger than that of the axial bearing bores in the radial outer wall. The housing further comprises a side wall having an opening sealed by a removable lateral cover. Furthermore, the housing constitutes a monobloc base body that has an opening at an end-face facing the housing cover, said opening having a width that is the largest among said axial passages and bore holes located inside the housing, making them accessible for machining through this opening in one set-up of the base body.

With the cover removed, the toothed gears can be fitted to the shafts through these openings. The bearing bores for the shafts can be produced and machined in the one-piece housing in a single set-up, so that, with a minimum number of parts involved, any causes of alignment errors are avoided. The cover sealing the opening in the side wall of the housing does not in any way affect the mounting of the shafts. The cover is a simple part which is merely required to close the opening and seal it against any escape of oil. It has turned out that this allows the avoidance of even minor positional inaccuracies, resulting in an improved efficiency and reduced running noises.

Further features and advantages of the invention will be apparent from the following description of a preferred embodiment and from the accompanying drawings, in which:

DETAILED DESCRIPTION OF THE INVENTION

Figure 1:
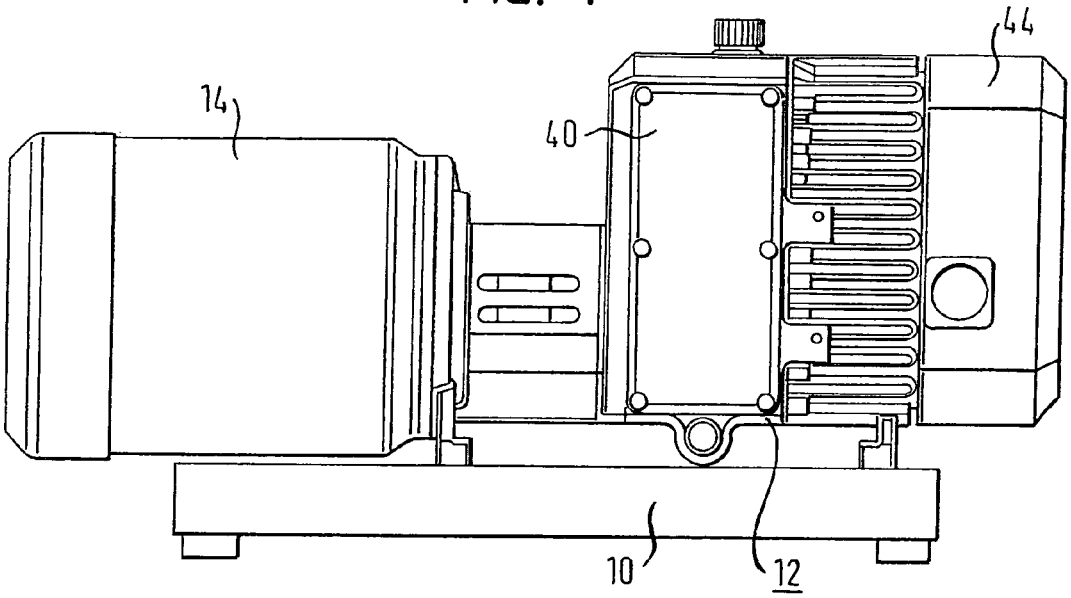
FIG. 1 shows a side view of a compressor machine.
Figure 2:
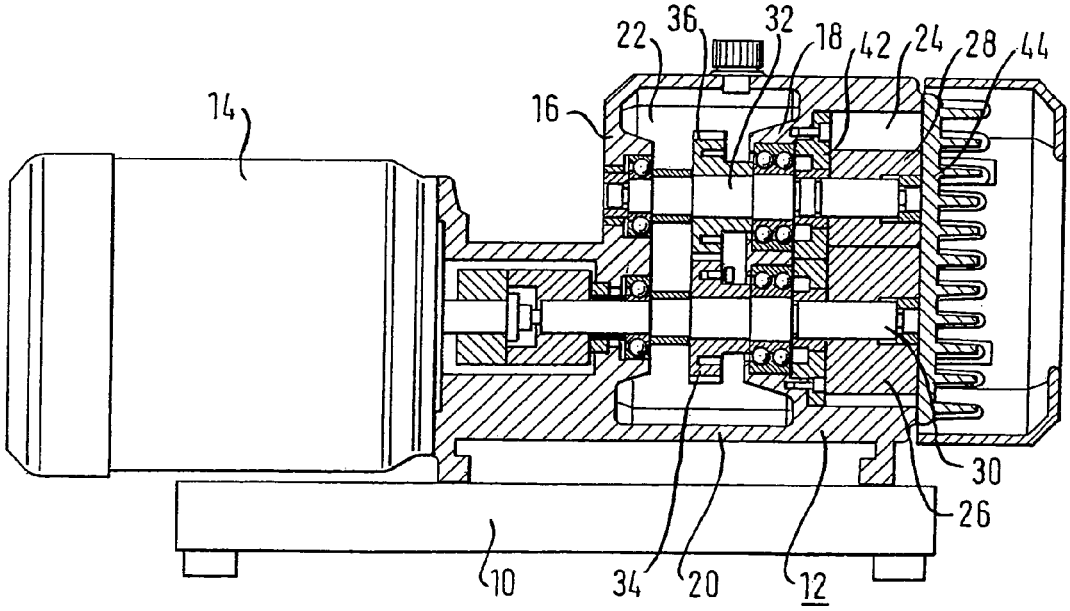
FIG. 2 shows an axial section of the compressor machine.
Figure 3:
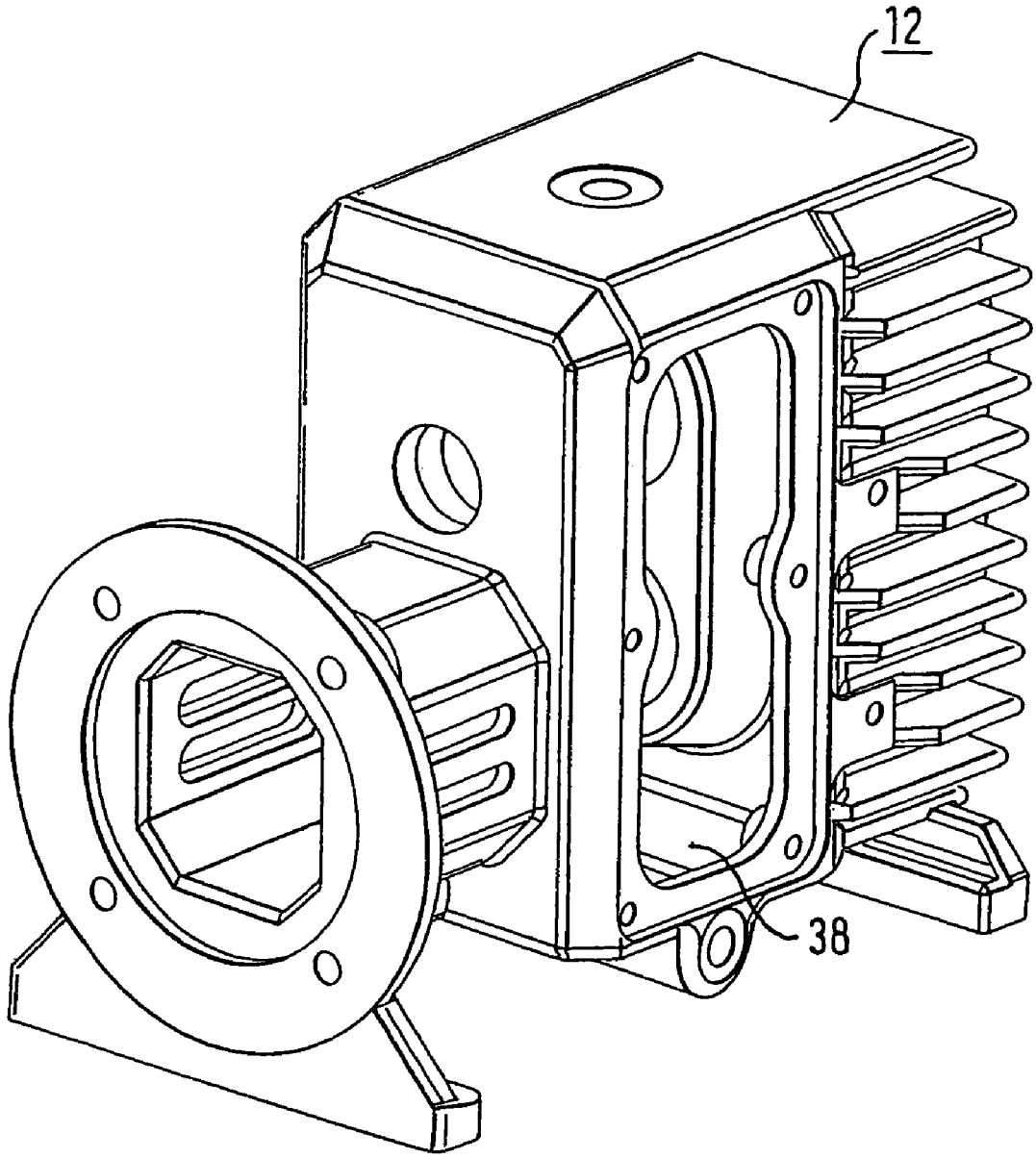
FIG. 3 shows a perspective view of a one-piece housing body of the compressor machine.

The compressor machine described by way of example below includes rotors having claw-type rotor blades and may be operated both as a compressor and as a vacuum pump.

A pedestal 10 mounts an integral housing body 12 having a flange-mounted electric motor 14. The housing body 12 has two radial, parallel and spaced apart walls 16, 18 connected with each other by a peripheral wall 20. The radial wall 16 forms an outer wall. The radial wall 18 forms an intermediate wall of the housing body 12 and separates a gear chamber 22 formed between the walls 16, 18 from a working chamber 24 which receives a pair of rotors 26, 28 having claw-type rotor blades. The rotor 26 is cantilever-mounted at an axial end of a shaft 30 which is supported in the radial walls 16, 18. The opposite axial end of the shaft 30 is directly coupled to the output shaft of the electric motor 14. The rotor 28 is cantilever-mounted at an axial end of a second shaft 32 which is likewise supported in the radial walls 16, 18. The shafts 30, 32 are parallel and spaced apart from each other. The shafts 30, 32 are coupled with each other by two intermeshing toothed gears 34, 36 arranged in the gear chamber 22, so that they rotate synchronously and with opposite sense of rotation.

The housing body 12 has a side wall with an opening 38 that can be closed off by a cover 40 fitted from outside. This opening 38 is dimensioned such that, with the cover 40 removed, the toothed gears 34, 36 can be inserted into the gear chamber 22 for installation on the shafts 30, 32.

On the side of the working chamber 24, a bearing cover plate 42 is applied to the intermediate wall 18. At its axial end facing away from the bearing cover plate 42, the working chamber 24 is closed off by a radial housing cover 44. The housing cover 44 is adjoined by a hood 46 which encompasses a fan that is coupled with the shaft 30, for example, or is provided with an external drive.

Figure 4:
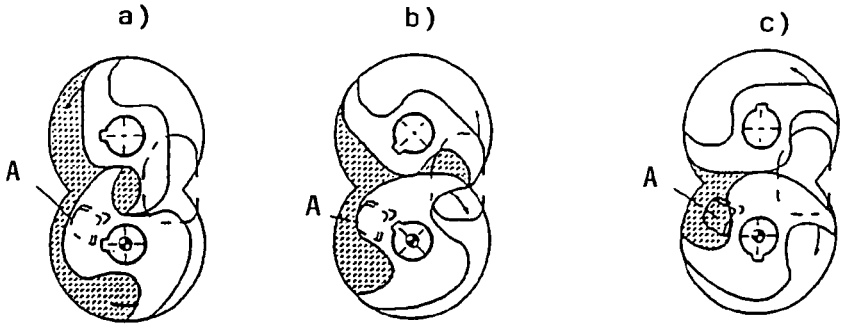
FIG. 4 shows three sketches to illustrate an internal compression.

The compressor machine described preferably involves a so-called claw-type compressor, that is, a machine with claw-shaped rotor blades and with an internal compression. FIG. 4 shows three phases in the cycle of such a machine, more specifically, in a) the beginning of the compression process, in b) the compression process at an advanced stage, and in c) the phase of expulsion of the compressed volume. The phase shown in FIG. 4*a*) is preceded by the inlet phase, in which a shared inlet chamber is filled, then divided up into two partial chambers, and finally combined into a joint volume, which then experiences the internal compression. An outlet port denoted by A is closed by one of the end faces of the lower rotor upon rotation of the rotors during the phase of internal compression and during the inlet phase. Starting with the condition illustrated in FIG. 4*b*), the outlet port A is exposed by the lower rotor to allow the compressed volume to be expulsed via the outlet port A. This outlet port leads axially through the housing cover 44 out of the working chamber of the compressor machine.

Figure 5:
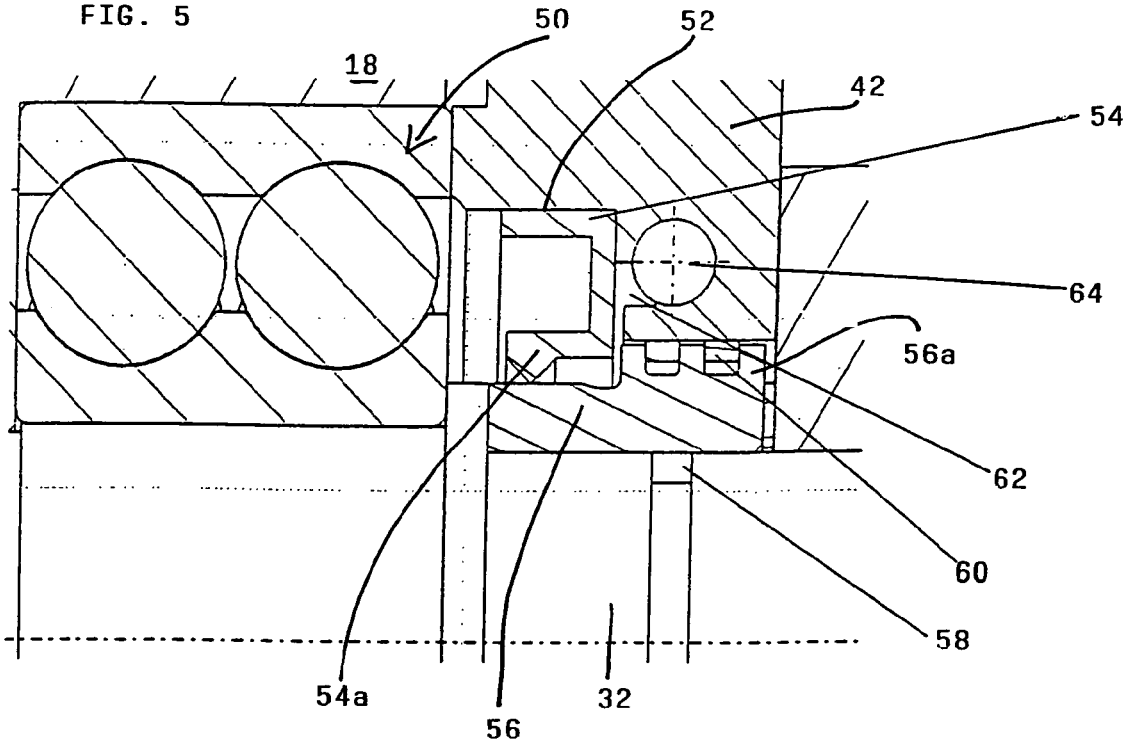
FIG. 5 shows an enlarged detail view of a shaft seal.

FIG. 5 shows an enlarged illustration of the shaft mounting at the intermediate wall 18 and the shaft seal arranged at the bearing cover plate 42. The shaft mounting consists of a double ball bearing generally denoted by 50. A recess 52 is formed in the bearing cover plate 42 to receive the shaft seal. Arranged in the recess 52 is a shaft sealing ring 54 which is made of a rubber elastic material and has a pointed sealing edge 54*a* which is in sealing engagement with the outer periphery of a sleeve 56 shrunk on the shaft 32. The sleeve 56 is sealed from the shaft 32 by a sealing ring 58. The sleeve 56 has a radially raised shoulder 56a having two sealing rings 60 received therein axially next to each other. The sealing rings 60 serve to seal the sleeve 56 from the inner periphery of the recess in the bearing cover plate 42. Remaining between the sealing ring 54 and the recess in the bearing cover plate 42 is a space 62 which communicates with a bore hole 64. The bore hole 64 leads through the bearing cover plate 42 and to the outside.

The special feature of the shaft seal illustrated in FIG. 5 consists in that it is arranged at the bearing cover plate 42, in this way allowing an unproblematic installation from the open end face of the base body of the housing.

Figure 6:
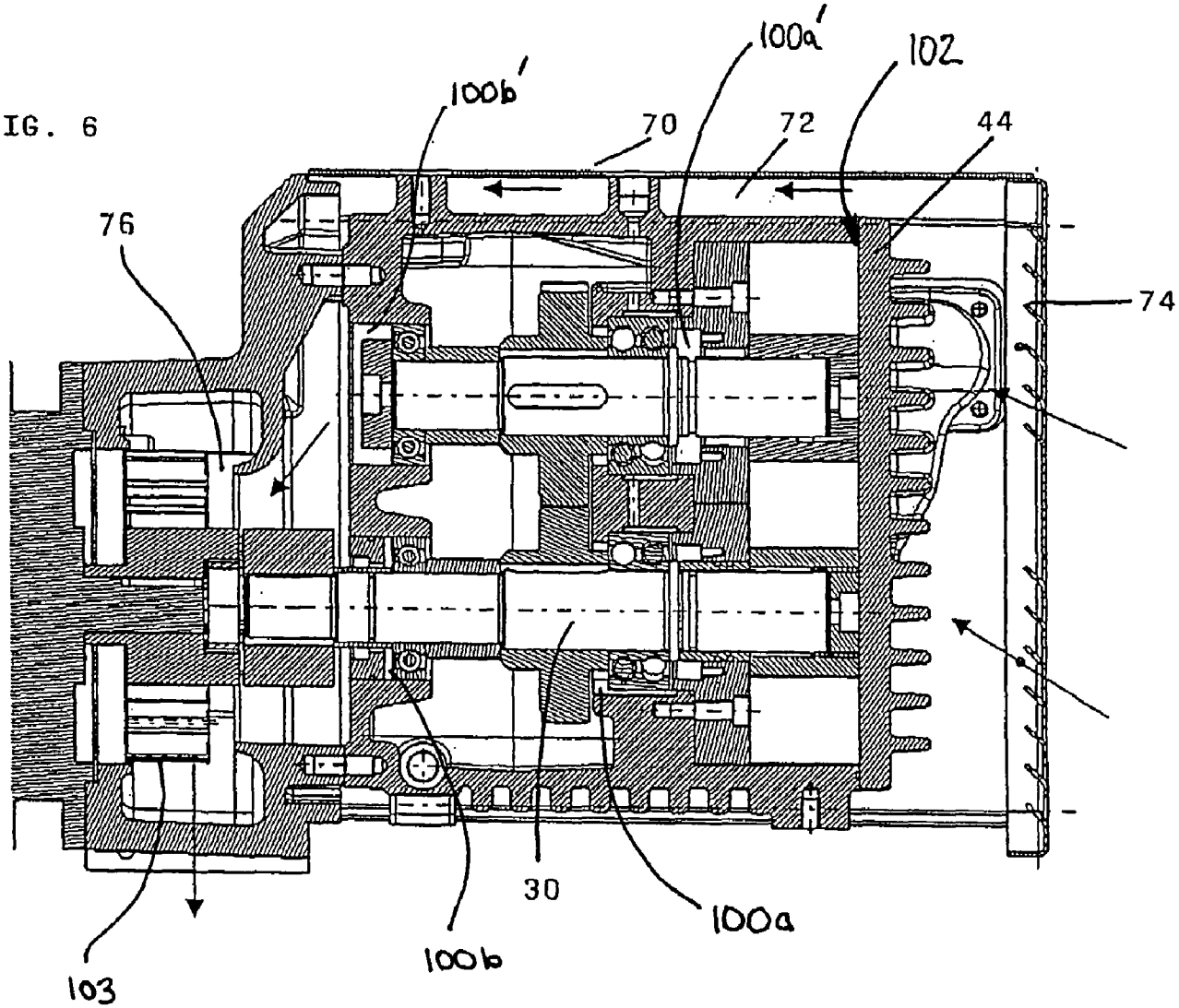
FIG. 6 shows an axial section of an alternative embodiment of the compressor machine.

In the embodiment of the compressor machine shown in FIG. 6, the base body of the housing is surrounded by a hood 70 defining axial cooling air ducts 72 together with the outer periphery of the housing. The cooling air ducts 72 extend from a protective grille 74 next to the housing cover 44 axially along the outer periphery of the housing as far as behind the gear chamber where they open radially inward into a fan chamber 76 having a fan arranged therein that has a rotor which is secured on a driving shaft coupled to the lower shaft 30. The cooling air exits radially downward.

For exemplification, it should be noted that the shafts are in axial passages 100*a*, 100*a*', 100*b*, 100*b*'. The passages include the axial bearing bores 100*b*, 100*b*' in the radical outer wall. The passages also include openings 100*a*, 100*a*' in the intermediate wall. Also, the fan 103 includes hood 70 as a covering.

The invention claimed is:

1. A compressor machine, comprising:

a housing;

two parallel, spaced apart shafts mounted in the housing;

intermeshing toothed gears mounted on the shafts, one of the shafts being driven directly and the other by said intermeshing toothed gears;

two rotors rotating in opposite directions, which are fitted to the two parallel, spaced apart shafts;

the housing including axial passages;

two radial walls which are configured in one piece with each other and with a peripheral wall;

the shafts being mounted between the radial walls;

the toothed gears being arranged between the radial walls;

one of the radial walls being a radial outer wall and the other an intermediate wall which on one side thereof defines together with the radial outer wall a gear chamber receiving the toothed gears and on the other side thereof defines a working chamber receiving the rotors;

on an end-face facing away from the intermediate wall, the working chamber is sealed by a radial housing cover;

the intermediate wall has axial through openings for accommodating shaft bearings having a width larger than that of the axial bearing bores in the radial outer wall;

a side wall having an opening sealed by a removable lateral cover;

the housing constituting a monobloc base body that has an opening at an end face facing the housing cover, said opening having a width that is the largest among said axial passages and bore holes located inside the housing, making them accessible for machining though this opening in one set-up of the base body.

2. The compressor machine according to claim 1, wherein the rotors are cantilever-mounted on the shafts.

3. The compressor machine according to claim 1, wherein on the end face facing away from the intermediate wall, the working chamber is sealed by a housing cover having an outlet port formed therein which upon rotation of the rotors is exposed subsequent to a phase of internal compression and is closed by the end face of one of the rotors during an inlet phase.

4. The compressor machine according to claim 1, wherein a bearing cover plate is applied to the intermediate wall on the side of the rotors.

5. The compressor machine according to claim 4, wherein the bearing cover plate has recesses for receiving shaft seals.

6. The compressor machine according to claim 1, wherein connected to the radial housing cover is a hood enclosing a fan.

7. The compressor machine according to claim 1, wherein the peripheral wall of the housing is surrounded by a hood defining axial cooling air ducts together with the peripheral wall, the cooling air ducts extending from the end face adjacent to the housing cover up to a fan arranged on a driving shaft on the side of the gear chamber facing away from the working chamber.

* * * * *